US006783227B2

(12) United States Patent
Suzuki et al.

(10) Patent No.: US 6,783,227 B2
(45) Date of Patent: Aug. 31, 2004

(54) INKJET PRINTER HAVING AN ACTIVE RAY SOURCE

(75) Inventors: Yoshiyuki Suzuki, Iruma (JP); Koji Matsushima, Akishima (JP); Satoshi Masumi, Hino (JP); Yoko Hirai, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/391,733

(22) Filed: Mar. 19, 2003

(65) Prior Publication Data

US 2003/0184631 A1 Oct. 2, 2003

(30) Foreign Application Priority Data

Mar. 27, 2002 (JP) ..... 2002-089355

(51) Int. Cl.[7] ..... B41J 2/01
(52) U.S. Cl. ..... 347/102; 347/101
(58) Field of Search ..... 347/101, 102, 347/100, 96; 34/60; 219/260, 216; 106/31.131

(56) References Cited

U.S. PATENT DOCUMENTS 4,303,924 A 12/1981 Young, Jr.
6,164,757 A 12/2000 Wen et al.

FOREIGN PATENT DOCUMENTS

| | | |
|---|---|---|
| JP | 60-132767 | 7/1985 |
| JP | 2002-011860 A | 1/2002 |
| WO | WO 01/83223 A1 | 11/2001 |
| WO | WO 02/18144 A1 | 3/2002 |

*Primary Examiner*—Stephen D. Meier
*Assistant Examiner*—Manish Shah
(74) *Attorney, Agent, or Firm*—Frishauf, Holtz, Goodman & Chick, P.C.

(57) ABSTRACT

An inkjet printer for recording an image on a recording medium with an active ray cure ink to be cured by exposure to an active ray, having a head for emitting the active ray cure ink onto a recording medium, an active ray source for emitting the active ray wherein the active ray source is arranged at the rear of the head in the direction of a relative movement of the head with respect to the recording medium during emission of ink, and in a same side where the head is provided with respect to the recording medium, and a shield member for preventing the active ray emitted by the active ray source from directly or indirectly entering into a trajectory formed by an ink particle emitted from the head and reaching the recording medium.

6 Claims, 12 Drawing Sheets

INKJET PRINTER HAVING AN ACTIVE RAY SOURCE

BACKGROUND OF THE INVENTION

The present invention relates to an inkjet printer for recording an image onto a recording medium by emission of ink particles to this recording medium.

An image recording method using an inkjet printer is often used as an image recording method for handy and economical image recording. A serial type inkjet printer feeds recording media of paper intermittently in the sub-scanning direction, and, when the recording media are stopped, moves the head on the recording media in the main scanning direction perpendicular to the sub-scanning direction. While the head is moving in the main scanning direction, the inkjet printer emits ink particles onto the recording media from the head by means of a piezoelectric element or a heater. An image is recorded on the recording medium by the operation of such an inkjet printer.

Ink used in an inkjet printer includes the active ray cure ink that is cured by application of active ray including ultraviolet ray and electron beam. The active ray cure ink is composed, for example, of color material, polymerizable monomer or oligomer, photopolymerization initiator for promoting monomer and oligomer crosslinking reaction and polymerization reaction by photocatalystic reaction, and photopolymerization accelerating agent. This ink is cured by crosslinking reaction or polymerization reaction by irradiation of active ray. The printer using such active ray cure ink for recording is less foul smelling than the printer using solvent based ink for recording, and is capable of recording on a recording medium having no ink absorbing ability. For these features, this ink has been drawing attention in recent years.

As disclosed in the Patent References 1 and 2, the inkjet printer for recording with ultraviolet cure ink cured by ultraviolet ray is provided with a UV source emitting ultraviolet rays. This printer emits ink particles of ultraviolet cure ink from the head to the recording medium, and moves the recording medium or head, whereby ultraviolet ray is applied to the ink particles landed on the recording medium from the UV source. This allows ink particles landed on the recording medium to be cured.

[Patent Reference 1]

Official Gazette of Japanese Application Patent Laid-Open Publication No. 2002-11860 (FIG. 19, pages 10 and 11)

[Patent Reference 2]

Official Gazette of Japanese Application Patent Laid-Open Publication No. S60-132767

If a long time is required between hitting of ink particles and the exposition to ultraviolet, the landed ink particles are not cured, and cause spread of the ink on the recording medium. To ensure a high quality print image, it is preferred that ink particles be exposed to ultraviolet rays immediately subsequent to the ultraviolet cure ink landing the recording medium, thereby allowing the ink particles to be cured. To do so, the head is placed close to the UV source so that ultraviolet rays are launched into ink particles immediately after they have hit the medium. However, the UV source emits ultraviolet rays radically. So if the head comes too close to the UV source, ink particles are exposed to ultraviolet rays before hitting the medium, and are cured, with the result that recording failure occurs. If the head comes too close to the UV source, ultraviolet rays emitted from the UV source will irradiate the head. If they have irradiated the head, ultraviolet cure ink present at the head outlet may be thickened or cured, and may not come out of the outlet.

To solve this problem, the object of the present invention is to provide a means for ensuring ink particles to be cured immediately after hitting a recording medium without allowing it to be cured before hitting.

SUMMARY OF THE INVENTION

The above object can be attained by the following configurations.

In the first configuration, an inkjet printer comprises: a head for emitting to a recording medium the ink to be cured by exposure to active ray, an active ray source for emitting active ray wherein the aforementioned active ray source is arranged backward in the direction of the relative movement of the head toward the recording medium during emission of ink, and on the side where the head is arranged with respect to the aforementioned recording medium, and a shielding member that prevents the active ray from the active ray source from directly or indirectly entering into the trajectory formed by ink particles emitted from the head and reaching the recording medium.

The invention of the first configuration uses a shielding member that prevents the active ray emitted from the active ray source from entering directly or indirectly the trajectory formed by ink particles emitted from the head and reaching the recording medium. This function decreases the possibility that ink particles emitted from the head are exposed to active ray before hitting the recording medium and are cured, and ensures the recording with high image quality. Use of such a shielding member permits the active ray source to be installed closer to the head. Thus this makes it possible that, immediately after hitting the recording medium, ink particles are exposed to the active ray coming from the active ray source, and are hence cured immediately after hitting the recording medium without ink particles unnecessarily spreading on the recording medium or blotting.

Since the shielding member prevents the active ray emitted from the active ray source from entering into the starting point of an ink particle trajectory, namely the ink outlet of the head, the ink at the outlet of the head is restrained from being thickened or cured. This function prevents the ink outlet from being clogged for a long period.

Here, direct entry of the active ray into the ink particle trajectory is defined as entry of the active ray from the active ray source into the ink particle trajectory without being reflected by inkjet printer parts or recording medium. Indirect entry of active ray into the ink particle trajectory is defined as entry of the active ray from the active ray source into the ink particle trajectory after having been reflected at least once by inkjet printer parts or recording medium.

In the second configuration, an inkjet printer according to the first configuration is further characterized in that the aforementioned shielding member is arranged between the aforementioned active ray source and head, and is provided with a first extension member extending toward the recording medium further than the surface of the head where ink particles are emitted.

According to the invention having the second configuration, the first extension member extends toward the recording medium further than the ink-emitting surface of the head between the active ray source and head. The active ray emitting from the active ray source is further shielded by the first extension member, and hence it becomes possible to prevent the active light from reaching the trajectory of ink particles. Accordingly, ink particles emitted from the head are not cured before hitting the recording medium. This allows the active ray source to be installed closer to the head. Thus, it becomes possible that ink particles are cured immediately after hitting the recording medium so that a high quality image is recorded on the recording medium.

In a third configuration, an inkjet printer according to the second configuration is further characterized in that the aforementioned shielding member is provided with a second extension member extending from the first extension member toward the trajectory in the direction crossing the direction in which the first extension member extends.

The invention of the third configuration has a second extension member which extends from the first extension member toward the ink particle trajectory (namely, in the crossing direction of the trajectory). Accordingly, the active ray reflected by the recording medium is cut off by the second extension member so that the active ray is hardly launched on the surface of the head where ink particles are emitted. This allows the active ray source to be installed closer to the head, with the result that ink particles can be cured immediately after having hit the recording medium.

In the fourth configuration, an inkjet printer according to the first configuration is further characterized in that the surface of the aforementioned second extension member opposite to the recording medium is designed in a rugged (convexo-concavo) form.

According to the invention having the fourth configuration, the surface of the second extension member opposite to the recording medium is designed in a rugged form. This can make possible to reduce the active ray being reflected by the second extension member at the surface area opposite to the recording medium, even when the active ray emitted from the active ray source enters at the second extension member, by the effects of scattering at the rugged surface and/or inner reflection at the second extension member. So even if active ray is repeatedly reflected between the second extension members and recording medium, it becomes possible to further prevent the active ray from entering into the ink particle emitting surface of the head or the trajectory. This configuration allows the active ray source to be installed closer to the head, with the result that ink particles can be cured immediately after hitting the recording medium.

In the fifth configuration, the inkjet printer according to the third and fourth configurations is further characterized in that the surface of the second extension member opposite to the recording medium absorbs active ray.

In the invention having the fifth configuration, the surface of the second extension member opposite to the recording medium absorbs active ray, even when the active ray is emitted from the active ray source and reflected by the recording medium to enter the area of second extension member. According to this feature, it becomes possible to prevent the active ray from being repeatedly reflected between the second extension member and recording medium, and from entering the ink particle emitting surface of the head or the trajectory. This configuration allows the active ray source to be installed closer to the head, with the result that ink particles can be cured immediately after hitting the recording medium.

In the sixth configuration, the inkjet printer according to any one of the first through fifth configurations is further characterized in that the aforementioned head, active ray source and shielding member are mounted so that they can move integrally with one another in the aforementioned direction of the relative movement.

According to the invention having the sixth configuration, the head is mounted movably in the direction of relative movement. This arrangement provides an inkjet printer where the image recording system is based on a serial method. Further, the active ray source is designed integrally movable with the head. Because of this arrangement, ink particles hitting the recording medium out of the head are exposed to the active ray source by the movement of the head and active ray source. Further, since the shielding member is mounted movable integrally with the head and active ray source in the direction of relative movement, an inkjet printer of serial method having the same effects as that of any one of configuration described in configuration 1 to 5 can be provided with simple structure and with simple mechanism.

In the seventh configuration, the inkjet printer according to any one of the first through fifth configurations is further characterized in that the aforementioned recording medium is fed in the reverse direction of relative movement, and the head is arranged along the direction orthogonal to the above-mentioned direction of relative movement.

According to the invention in the seventh configuration, the head is mounted along the direction orthogonal to the direction of relative movement. This arrangement provides an inkjet printer where the image recording system is based on a line head method. Since the active ray source is arranged backward the head in the direction of relative movement of the head in respect to the recording medium, ink particles having hit the recording medium out of the head are exposed to the active ray source as the recording medium is transported. And inkjet printer of line head method having the same effects as that of any one of configuration described in configuration 1 to 5 can be provided with simple structure and with simple mechanism.

In the eighth configuration, the inkjet printer according to any one of the first through seventh configurations is further characterized in that ink emitted from the above-mentioned head is cation cure ink.

According to the invention having the eighth configuration, cation cure ink has a higher sensitivity to active ray than radical cure ink, and is susceptible to active ray. However, a shielding member is provided between the head and active ray source. This arrangement prevents such cation ink from being thickened or cured, in the head or during the flight in air. Further, since the cation cure ink is used, ultraviolet light source with low illumination can be used as the active ray source to make it possible to provide a small sized and low-cost inkjet printer, which forms a stable and high image quality for a long period.

DETAILED DESCRIPTION OF THE PREFERRED EMBODIMENTS

The following describes the specific embodiments of the present invention with reference to drawings, without the present invention being restricted to the illustrated examples.

[First Embodiment]

Figure 1:
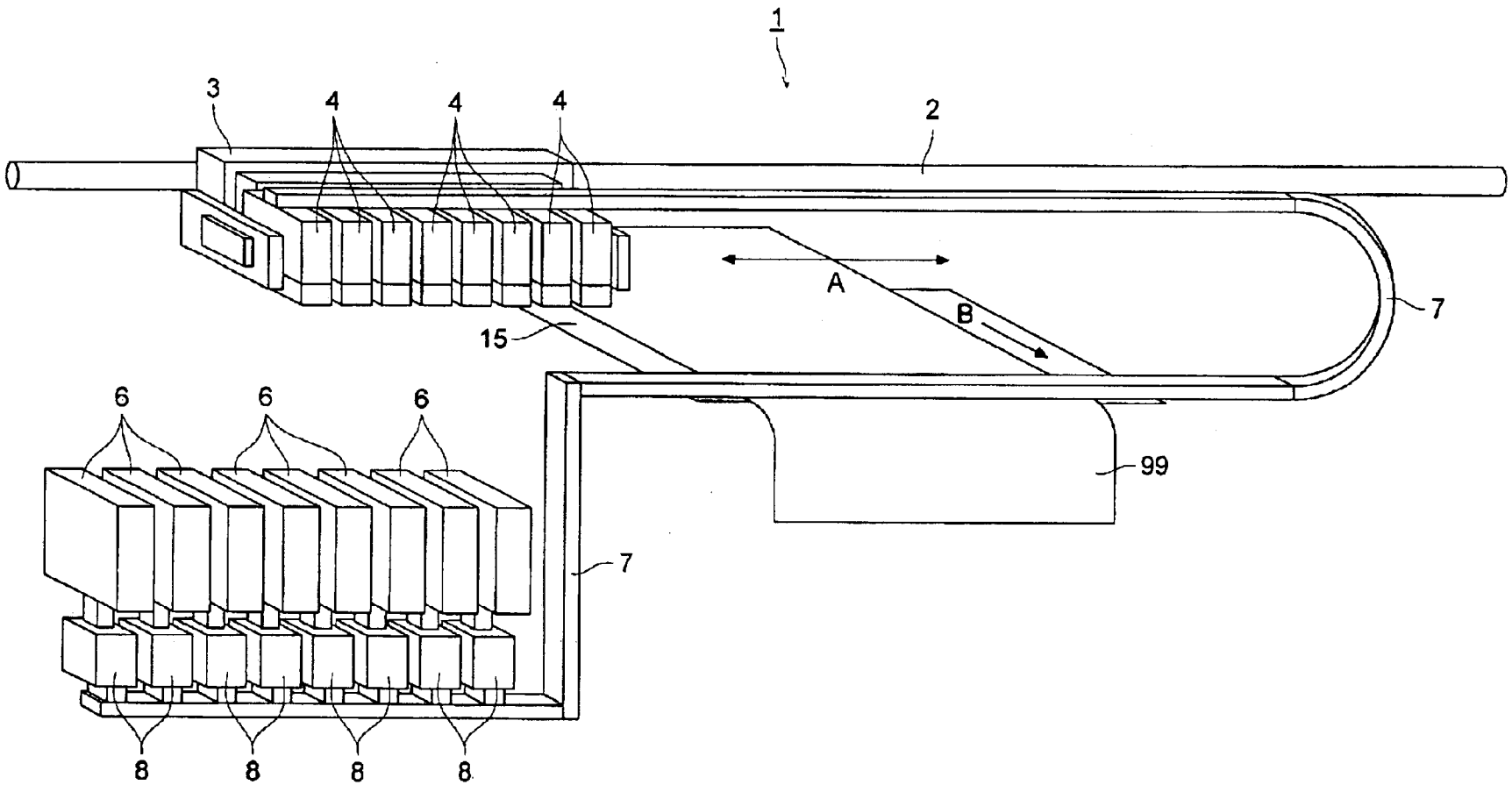
FIG. 1 is a perspective view representing the major portions of the inkjet printer based on a serial method according to the present invention.

FIG. 1 shows a serial inkjet printer 1.

In this inkjet printer 1, the ultraviolet cure ink (UV ink) activated and cured by exposure to ultraviolet rays is emitted toward a recording medium 99 in the form of particles (hereinafter referred to as "ink particles"), and is exposed to ultraviolet rays after ink particles have hit the recording medium, whereby an image is formed on the recording medium 99. In the following description, ultraviolet cure ink is used as active ray cure ink. It is also possible to use the ink that can be cured by exposure to such active ray as infrared ray, visible light, electronic ray and X ray. Here, active ray should be interpreted in a broad sense. In other words, active ray used in this specification refers not only to the light capable to ionizing air, but also to electromagnetic wave such as ultraviolet ray, visible light and infrared ray.

The inkjet printer 1 comprises:

a platen 15 of a tabular form, a feed mechanism (not illustrated) for feeding a sheet-like recording medium 99 to the downstream side in the sub-scanning direction B, a guide member 2 arranged upstream from the platen 15 to extend in the main scanning direction A approximately perpendicular to the sub-scanning direction B, a carriage 3 as a moving body guided the guide member 2 located over the recording medium 99 to travel in the main scanning direction A along the guide member 2, a plurality of heads 4, 4, . . . that emit ultraviolet cure ink in the form of ink particles, a plurality of UV light sources 5, 5, . . . (illustrated in FIG. 2, etc.), which is arranged at the same side as where the head 4,4, . . . is provided with respect to the recording medium 99, a cover 9 (illustrated in FIG. 2, etc.) arranged on each of UV light sources 5 for the purpose of preventing the ultraviolet rays from the UV light source 5 from directly or indirectly entering the trajectory of ink particles, a plurality of ink tanks 6 arranged below the carriage 3 for the purpose of storing ultraviolet cure ink, an ink feed path for supplying ultraviolet cure ink to the head 4 from ink tank 6, and a variable pressure pump provided on each ink tank 6.

The aforementioned feed mechanism comprises a feed motor and fed roller (not illustrated). The feed roller is turned by the feed motor so that recording media 99 are fed in the sub-scanning direction B. This feed mechanism is designed to feed the recording media 99 synchronously with the operation of the carriage 3. To put it more specifically, it is designed to provide an intermittent feed of recording media 99. In other words, the feed mechanism is repeats start and stop of the recording media 99.

The platen 15 supports the recording media 99 flatly from below as they are fed by the feed mechanism.

The recording medium 99 used in the present Embodiment includes various types of paper used in the normal inkjet printer such as plain paper, recycled paper and calendered paper, various types of textiles, various types of non-woven fabric, resin, metal and glass. Further, it is possible to use the recording media 99 in the form of rolls, cut sheets and cardboards.

In particular, transparent or opaque non-absorbing resin-made film used for so-called soft package is employed as the recording medium 99 for the present Embodiment. To put it more specifically, the resin-made film includes polyethylene terephthalate, polyester, polyolefin, polyamide, polyester amide, polyether, polyimide, polyamidoimide, polystyrene, polycarbonate, poly-ρ-phenylene sulfide, polyether ester, polyvinyl chloride, poly(metha)acrylate, polyethylene, polypropylene and nylon. It is also possible to use the copolymers and mixtures thereof, as well as materials formed by crosslinking these resins. Especially when one wishes to select the type of the resin constituting the resin-made film, it is preferred that any one of polyethylene terephthalate, polystyrene, polypropylene and nylon be selected in terms of film transparency, dimensional stability, rigidity, environmental load and cost. It is also preferred that the resin film have a thickness of 2 $\mu$m (micrometer) or more (preferably 6 $\mu$m and over up to and including 50 $\mu$m). It is also desirable that the surface of the resin film support member be provided with surface treatment such as corona discharge and adhesion promoting treatment.

The known opaque recording media such as various types of paper with the surface coated with resin, films containing pigment and plastic foams can also be used as recording media 99 for the present Embodiment.

The carriage 3 is used for intermittent feed of recording media 99 through the aforementioned feed mechanism, and makes a reciprocal movement along the guide member 2 in the main scanning direction A. To put it more specifically, it makes at least one movement in the main scanning direction A when the recording medium 99 is stopped. Further, the carriage 3 travels at an approximately uniform speed in the recording range over the recording medium 99. It travels at a reduced speed when it gets out of the recording range to reach the turn-back end in the recording range. It travels at an increased speed when it turns back at the turn-back end to move to the recording range. According to the example given in FIG. 1, the carriage 3 travels at an increased speed when it moves from the left to the position immediately above the recording medium 99. It travels at a uniform speed from left to right in the space (within the recording range) immediately above the recording medium 99, and moves at a reduced speed from the space immediately above the recording medium 99 to the right end of the traveling range. After turning back at the right end, it travels at an increased speed until it is positioned immediately above the recording medium 99. Then it travels at a uniform speed from right to left immediately above the recording medium 99, and travels at a reduced speed from the position immediately above the recording medium 99 to the left end in the traveling range. As will be described in details later, while the carriage 3 is moving in the main scanning direction A, the recording medium 99 stops operation and ink particles are emitted by the heads 4, 4, . . . . Then an image is formed on the recording medium 99. In this case, the relative movement of the carriage 3 with respect to the recording medium 99 is performed in the main scanning direction A where the carriage 3 moves.

A plurality of ink tanks 6, 6, . . . are arranged out of the traveling range of the carriage 3. These ink tanks 6, 6, . . . are replaceable ink cartridges, and ultraviolet cure ink is stored in each tank 6.

The colors of the ultraviolet cure ink used in the inkjet printer 1 are based on yellow (Y), magenta (M), cyan (C) and black (K). They also include white (W), light yellow (LY), light magenta (LM), light cyan (LC) and light black (LK). Each ink tank 6 contains ultraviolet cure ink having any one of these colors. Basically, ultraviolet cure ink of a different color is contained in each ink tank 6. It is also possible that ultraviolet cure ink of the same color is contained in two or more ink tanks 6.

The ultraviolet cure ink stored in these ink tanks 6, 6, . . . is applicable if it conforms to the requirements disclosed in "Curing system based on photooxidation base generator (Section 1)" and "Light Induced alternating copolymer (Section 2)" in "Light Cure System (Chapter 4") of "Light Cure Technique—Selection and Blending Conditions of Resin and Initiator, and Measurement and Assessment of Hardness—(Information provided by Technical Association)". It may be the one that is cured by radial photopolymerization or cation polymerization.

To put it more specifically, the ultraviolet cure ink used in the present Embodiment is cured by exposure to the ultraviolet ray as activated ray. Its main components include at least a pigment (a coloring material) conforming to each color, a monomer and polymerizable compound thereof (including the known polymerizable compound), and a photoreaction initiator. The ultraviolet cure ink made of such components is cured by crosslinking of the monomer and polymerization reaction as the photoreaction initiator acts on the polymerizable compound when exposed to ultraviolet rays. However, when the ink conforming to the requirements of the aforementioned the "Light Induced alternating copolymer (Section 2)" is used in the present Embodiment, photo-initiator need not be used.

The aforementioned ultraviolet cure ink can be broadly classified in two types; a radical cure ink containing radical polymerizable compound as polymerizable compound and a cation cure ink containing cation polymerizable compound. Either type is applicable as ink used in the present embodiment. Hybrid type ink made of a combination between radical cure ink and cation cure ink can be used for the present Embodiment.

However, since cation cure ink characterized by very little trouble or without trouble in polymerization reaction due to oxygen is superior in functionality and versatility, cation cure ink is used in the present Embodiment. To put it more specifically, the cation cure ink used in the present Embodiment is a mixture comprising at least a cation polymerizable compound including oxetane compound, epoxy compound and vinyl ether compound, photo-cation initiator and coloring material. It is cured when exposed to ultraviolet rays, as described above.

The ink tank 6 communicates with each head 4 through the ink feed path 7 so that ultraviolet cure ink can be supplied to the head 14 from the ink tank 6 for each color. The ink feed path 7 is formed of a flexible member so that it can respond accurately to the traveling of the carriage 3.

Variable pressure pumps 8, 8, . . . are provided at the connections between ink tanks 6 and ink feed paths 7, respectively. Means are provided to ensure that the amount of ink supplied from the ink tank 6 to the head 4 is changed when variable pressure pump 8 has changed the internal pressure of the ink feed path 7 connecting between the ink tank 6 and head 4.

Figure 2:
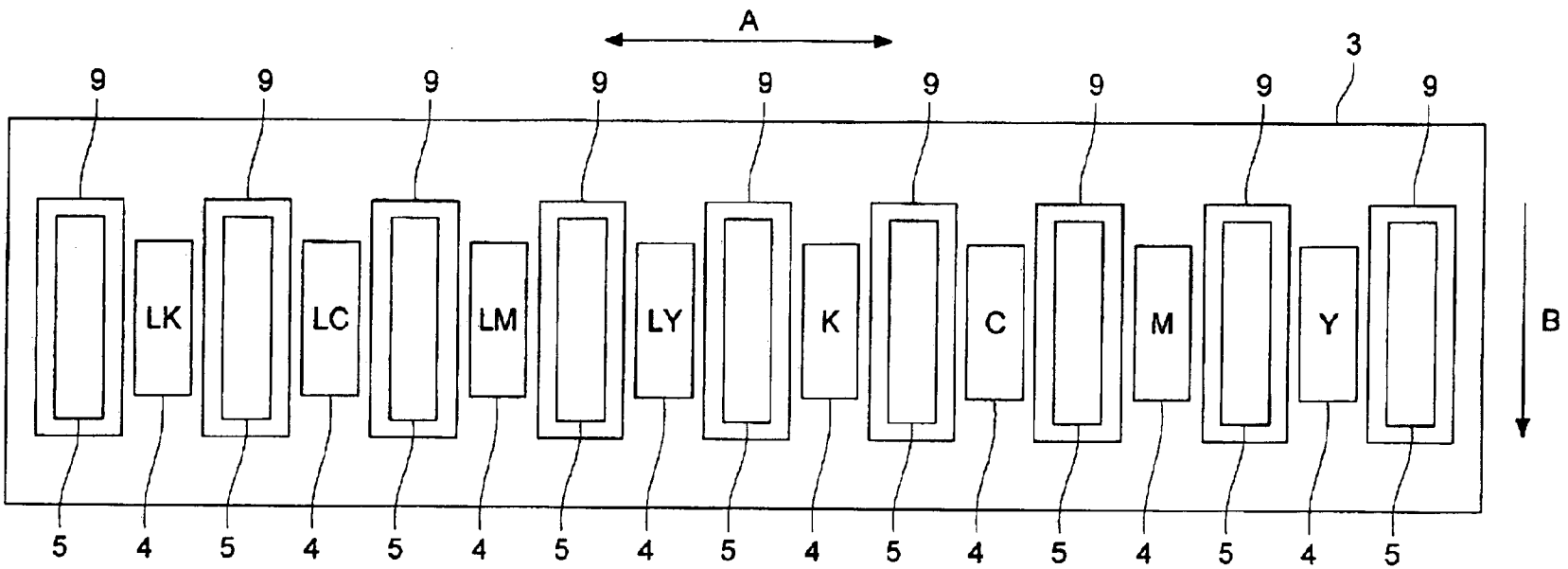
FIG. 2 is a bottom view representing a carriage arranged on the above-mentioned inkjet printer.
Figure 3:
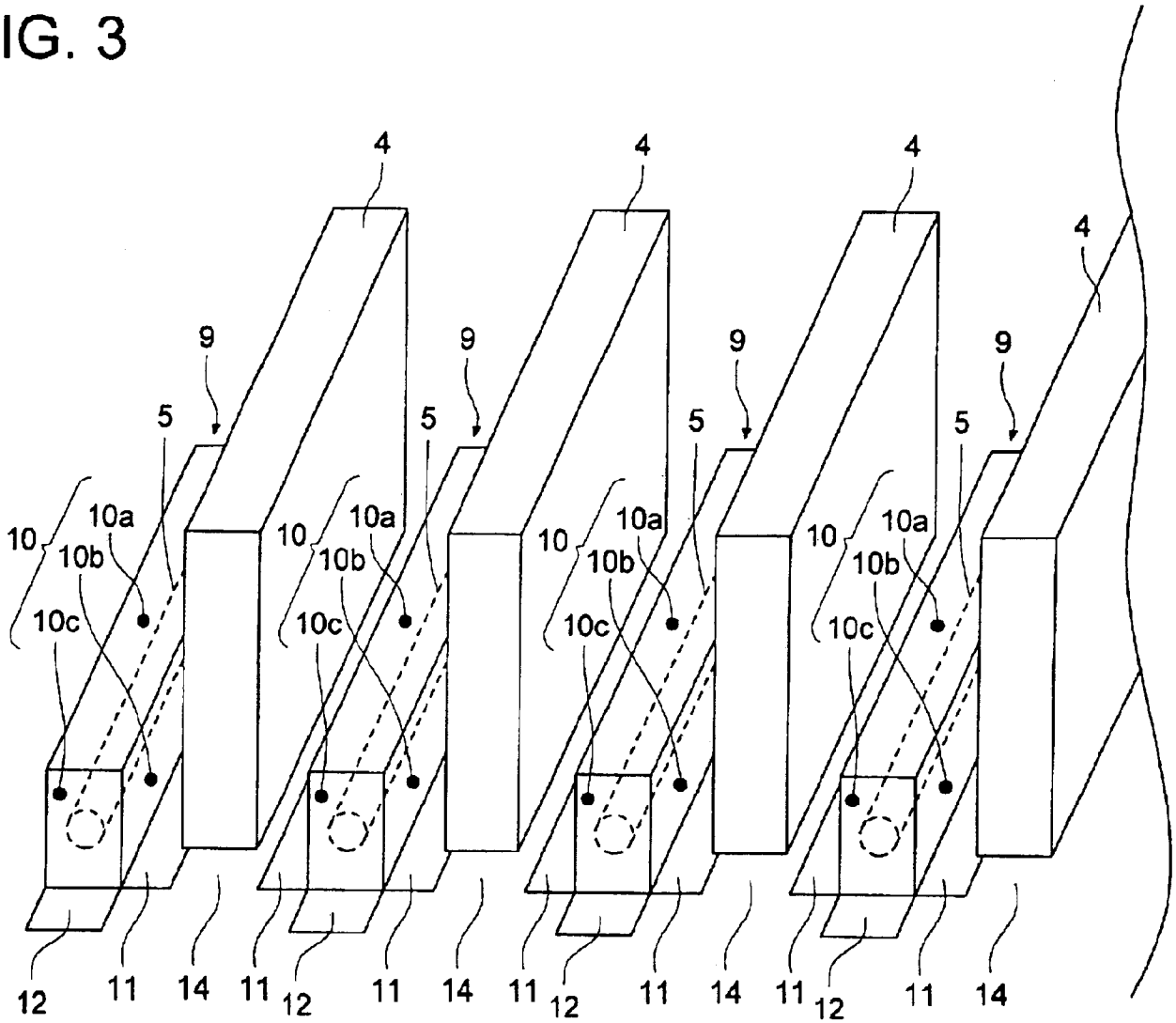
FIG. 3 is a perspective view representing multiple heads and multiple light sources provided on the carriage.
Figure 4:
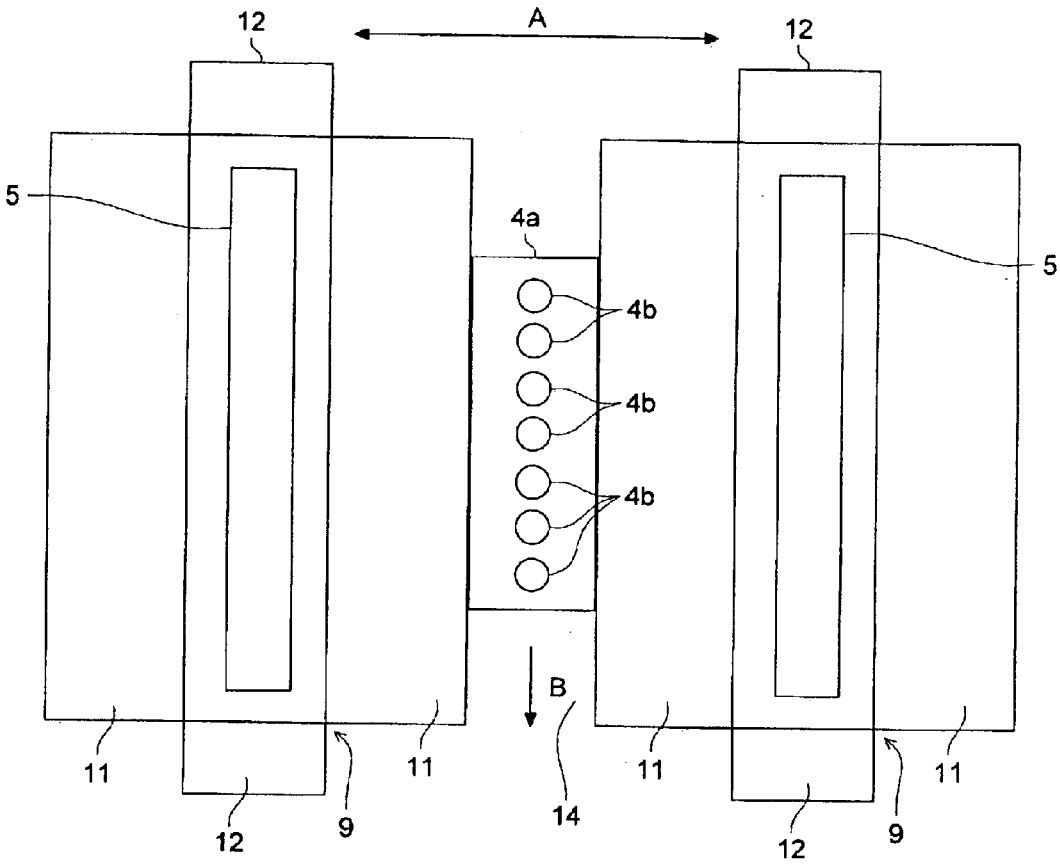
FIGS. 4(*a*) and (*b*) are drawings representing heads arranged on the carriage and light sources arranged on both sides thereof.
Figure 4:
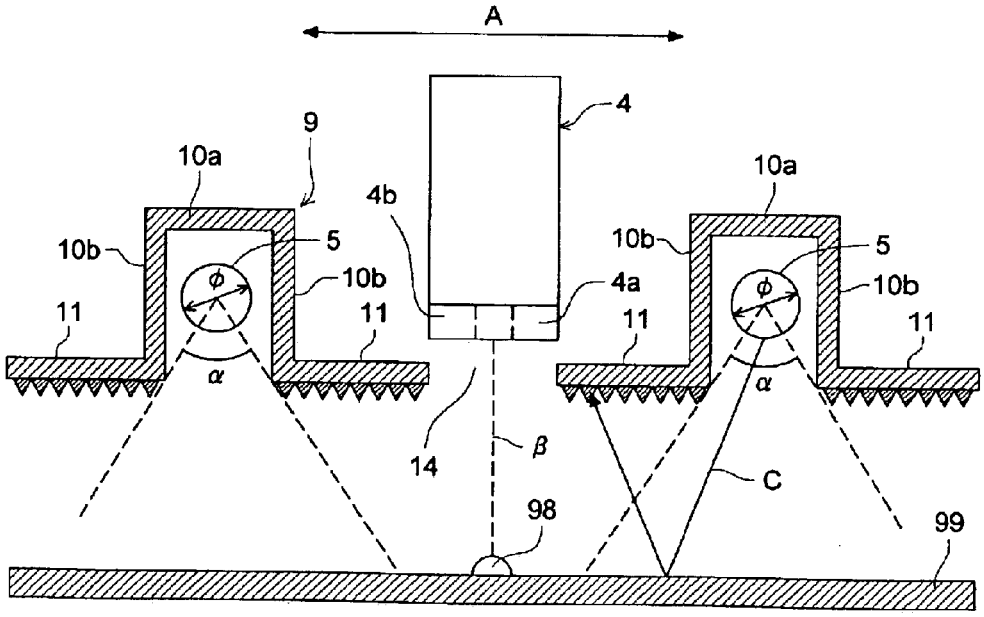

The following describes the details of carriage 3 with reference to FIGS. 2 through 4:

FIG. 2 is a bottom view of carriage 3. FIG. 3 is a partial perspective view representing multiple heads 4, 4, . . . , ultraviolet ray source 5, 5, . . . , and cover 9, 9 provided on the carriage. FIG. 4(*a*) is a bottom view showing one head 4 and ultraviolet ray sources 5, 5 and covers 9, 9 arranged on both sides thereof. FIG. 4(*b*) is a front view of this head 4 and these ultraviolet ray sources 5, 5 and covers 9, 9 as viewed in the sub-scanning direction B.

As shown in FIGS. 2 and 3, heads 4, 4, . . . are mounted on the carriage 3, and ultraviolet ray sources 5, 5, . . . are also mounted on the carriage 3. Further, covers 9, 9, . . . are installed on the carriage 3 so as to cover each ultraviolet ray source 5. The carriage 3, heads 4, 4, . . . , ultraviolet ray sources 5, 5, . . . and covers 9, 9, . . . are located above the recording medium 99. Therefore, both heads 4, 4, . . . and ultraviolet ray sources 5, 5, . . . travels together with the carriage 3 in the main scanning direction A above the recording medium 99.

Heads 4, 4, . . . are formed approximately in the form of a rectangular parallelepiped. These heads 4, 4, . . . are parallel to one another, and are arranged linearly at an equally spaced interval in the main scanning direction A. In other words, the straight lines connecting between heads 4, 4, . . . are parallel in the main scanning direction A and, at the same time, adjacent two heads 4, 4 are arranged at an equally spaced interval. The ultraviolet ray sources 5, 5, . . . are parallel with each other in the longitudinal direction, and are arranged linearly in the scanning direction A at an equally spaced interval. One head 4 is installed between any two ultraviolet ray sources 5, 5, and head 4 and ultraviolet ray source 5 are alternately arranged in the main scanning direction A.

In a row comprising these heads 4, 4, . . . , and ultraviolet ray sources 5, 5, . . . , ultraviolet ray sources 5 are provided at both ends in the main scanning direction A. The distance from the head 4 to one of ultraviolet ray sources 5 on one side of head 4 is equal to the distance from the head 4 to the ultraviolet ray source 5 on other side of that head 4. In other words, heads 4 and ultraviolet ray sources 5 are lineally arranged alternately and at an equally spaced interval. The distance from the head 4 to the ultraviolet ray source 5 on its side is about 30 cm, without being restricted to that figure.

As shown in FIGS. 4(*a*) and (*b*), nozzle plate 4*a* is provided on the bottom of the head 4, and the bottom surface of the head 4 is composed of this nozzle plate 4*a*, which is arranged opposite to the recording medium 99 located below. The nozzle plate 4*a* is provided with a plurality of outlets 4*b*, 4*b*, . . . connecting between the spaces inside and outside the head 4. The outlets 4*b*, 4*b*, . . . are linearly arranged in one row in the sub-scanning direction B. Each head 4 has for each outlet 4*b* a piezoelectric element for applying pressure to internal ink by deformation, a heating element for applying pressure to internal ink through film boiling of internal ink, and other elements for applying pressure to internal ink. Ink is emitted separately from each outlet 4*b* by the operation of these elements.

Ultraviolet cure ink is supplied into the space inside the head 4 from the ink tank 6. Since this internal space is common to all outlets 4*b*, 4*b*, . . . , ink particles emitted from each outlets 4*b* have the same color. Basically, ink particles of ultraviolet cure ink of different colors for each head 4 are emitted, but it is also possible that the ultraviolet cure ink of the same color is emitted from two or more heads. The alphabet shown on each head 4 in FIG. 2 signifies the color of ink particles to be emitted. However, the color arrangement is restricted to what is shown in FIG. 2.

The ultraviolet ray source 5 emits ultraviolet ray of a specific wavelength range (e.g. 250 nm) with stabilized irradiation energy. The wavelength and irradiation strength of the ultraviolet ray emitted from the ultraviolet ray source 5 is set up as appropriate in conformity to the material of the recording medium 99 or the type of the ultraviolet cure ink. A LED (light emitting diode), fluorescent lamp, high pressure mercury lamp, metal halide lamp, high pressure spot lamp and xenon lamp can be utilized as an ultraviolet ray source 5. It is also possible to use the ultraviolet ray source 5 where the wavelength and irradiation energy of the ultraviolet ray can be changed in conformity to the material of the recording medium and type of the ultraviolet cure ink.

The length of the ultraviolet ray source 5 is equal to or greater than the length of the head 4 and the head plate 4*a* in the sub-scanning direction B. Further, the diameter of the ultraviolet ray source 5 is 5 mm in the present embodiment, but is not restricted to this figure. Further, as shown in FIG. 4(*b*), the ultraviolet ray source 5 is located above the head plate 4*a* as the lower surface of the head 4.

As shown in FIGS. 3 and 4, the cover 9 as the shielding member comprises:

a box 10 formed in a rectangular parallelepiped opened in the downward direction, flanges (second extension member) 11, 11 located on the right and left sides of the box 10 and extending toward the heads 4, 4 on both sides from the lower end, and flanges 12, 12 located on the front and backsides and extending in the sub-scanning direction B from the lower end. The box 10 comprises:

a top surface 10*a* opposite to the recording medium 99 over the ultraviolet ray source 5, side surfaces (second extension member) 10*b*, 10*b* facing in the main scanning direction A (one side surface 10*b* shown in FIG. 3, and side surfaces 10*c*, 10*c* facing in the sub-scanning direction B (one side surface 10*c* shown in FIG. 3 and reference numeral 10*c* omitted in FIG. 4).

As shown in FIG. 3, side surface 10*c* extends downward from both ends in the sub-scanning direction B of the top surface 10*a*. The flange 12 extends in the sub-scanning direction B from the lower end.

The side surface 10*b* is located between the ultraviolet ray source 5 and its neighboring head 4 extends downward from both ends in the main scanning direction A, namely toward the recording medium 99 from both ends. The side surface 10*b* extends toward recording medium 99 further than the lower surface (i.e. nozzle plate 4*a*) of the head, and the lower end of the side surface 10*b* is positioned below the lower surface of the head 4. The irradiation range α of the ultraviolet ray source 5 is restricted by two side surfaces 10*b*, 10*b*. As the details are given in FIG. 5(*a*), a tangential line is found as connecting between the point hit by ink particles 98 and the contact point γ of the ultraviolet ray source 5 when viewed from the front. The side surface 10*b* crosses this tangential line γ, and extends still below the tangential line γ. In other words, the ultraviolet ray emitted from the ultraviolet ray source 5 is blocked by side surfaces 10*b*, 10*b*, thereby ensuring that ultraviolet ray coming from the ultraviolet ray source 5 does not directly enter the trajectory β formed by ink particles 98 emitted from the adjacent head 4 and reaching the recording medium 99. Basically, the trajectory β cross the lower surface of the head 4 at a right angle.

The flange 11 extends in the direction orthogonal to the direction where the side surface 10*b* extends, namely in the main scanning direction A, toward the head 4 adjacent to the side surface 10*b*. In other words, the flange 11 extends toward the trajectory β of the ink particles emitted from the lower end of the side surface 10*b* by the head 4 adjacent to the side surface 10*b*. Further, the flange 11 is located below the lower surface of the head 4, and the power surface of the flange 11 is opposite to the recording medium 99.

The flange 1, especially, the lower surface of the flange 11 is flush with the lower surface of the head 4, and the space between the lower surface of the flange 11 and recording medium 99 can be the same as the space between the lower surface of the head 4 and recording medium 99.

The flange 1, especially, the lower surface of the flange 11 absorbs the ultraviolet ray. The flange 11 or its lower surface can be provided with a high ultraviolet ray absorption rate by many methods, which will be given below as examples: There is a method by which the entire flange 11 or the lower surface of the flange 11 is provided with the material having a high ultraviolet ray absorption rate through various types of metal oxide treatment such as alumite treatment. Another method is by providing the entire flange 11 or the lower surface of the flange 11 with plating, vapor deposition and sputtering. A third method is by using a material having a high ultraviolet ray absorption rate to produce flange 11. A fourth method is by coating various types of ultraviolet ray absorbents on the ensure surface or the lower surface of the flange 11. The material having a high ultraviolet ray absorption rate includes inorganic substances such as powder including carbon black, titanium oxide formed into extra-fine particles, zinc oxide, and iron oxide (α—$Fe_2O_3$, $Fe_3O_4$), and organic substances such as benzotriazole compound and aromatic compound.

The flange 11 is formed in a rugged shape (convexo-concave shape) on the lower surface of the flange 11 in particular as shown in FIG. 4(*b*). The lower surface of the flange 11 is formed in convexo-concave shape by making it, for example, in a bellows shape, in such a shape that rectangular or triangular shapes in cross section are repeatedly present, or in an undulating shape. In the present embodiment, saw-tooth shape in cross section, where triangular shapes in cross section are repeatedly present, is formed as shown in FIG. 4(*b*). Incidentally, it is natural that this convexo-concave portion may be integrally molded with the flange 11.

In this way, by making the opposing surface to the recording medium (lower surface) of the flange 11, which is the second extension member, in a convexo-concave shape as to scatter the active ray (ultraviolet ray, in the present embodiment) entered and/or to reduce the reflection, it becomes possible to decrease undesired ink cure generated by the active ray irradiation with the reflected ray or repeatedly reflected ray to the ink outlet in head 4 or the ink particles before hitting the recording medium.

Incidentally, in the present embodiment, the flange 11, the lower surface of it in particular is shown as being formed in a convexo-concave shape and being provided the property of UV light absorption as well, however only one of the above two features can be applied. For example, the property of UV light absorption may be provided without convexo-concave shape, or convexo-concave shape may be formed without the property of UV light absorption. However it is preferable to make the flange 11, the lower surface of it in particular, in a convexo-concave shape and being provided with the property of UV light absorption as well, since it further decreases undesired ink cure generated by the active ray irradiation with the reflected ray or repeatedly reflected ray to the ink outlet in head 4 or the ink particles before hitting the recording medium.

Further, the light shield member for decreasing the irradiation of the active ray such as the UV ray to the ink outlet surface in head 4 or to the ink particles before hitting the recording medium, may be for example, other than the above described example, a member where a light shield cloth such as a teremp or a black pile textile is adhered onto the flange 11, the lower surface of it in particular.

Furthermore, after making the flange 11, the lower surface of it in particular in a convexo-concave shape, these members may be adhered on to the surface. Still further, the flange 11 may be a member molded with resin mixed with carbon black and the like.

A space 14 is provided between the flange 11 of the cover 9 and the flange 11 of its adjacent cover 9, and a head 4 is located immediately above the space 14. The trajectory β passes through the space 14, and the ink particles 98 emitted from the head 4 hit the recording medium 99 through the space 14. As shown in FIG. 3, for the cover 9 placed over the ultraviolet ray sources 5 located on both ends (only the ultraviolet ray source 5 located on the left end is illustrated in FIG. 3), the flange 11 is provided only on the side surface 10*b* of its adjacent ultraviolet ray source 5. No flange 11 is provided on the adjacent side surface 10*b* devoid of any ultraviolet ray source 5.

The following describes the operation of the inkjet printer 1 having the aforementioned configuration:

During the operation of the inkjet printer 1, ultraviolet rays are emitted from the ultraviolet ray source 5, and recording medium 99 is exposed to ultraviolet rays. The inkjet printer 1 uses a feed mechanism to provide an intermittent feed of the recording medium 99 in the sub-scanning direction B. When the recording medium 99 is stopped, the carriage 3 travels in the main scanning direction A at least once. It travels at a uniform speed in the recording range, i.e. immediately above the recording medium 99. While the carriage 3 is moving in the recording range, each head 4 allows ink particles to be emitted from outlets 4*b*, 4*b*, . . . , and the emitted ink particles hit the recording medium 99 through the space 14. Ink particles having hit the recording medium are cured when exposed to the ultraviolet rays emitted from the adjacent ultraviolet ray source 5 arranged backward from the head 4 having emitted ink particles in the traveling direction of the carriage 3. As described above, an image is recorded on the recording medium 99 backward in the traveling direction of the head 4 by the movement of the head 4 together with the carriage 3. Of two ultraviolet ray sources 5, 5, the one arranged backward in the traveling direction of the carriage 3 is arranged backward from the head 4 in the direction of the relative movement of the head 4 with respect to the recording medium 99.

In the similar manner, the inkjet printer 1 allows the recording medium 99 to be fed a specified distance in the sub-scanning direction B using the feed mechanism after reciprocal traveling of the carriage 3, emission of ink particles and irradiation of the ink particles having hit the recording medium 99 several times. After the recording medium 99 has been stopped again, the inkjet printer 1 again causes reciprocal traveling of the carriage 3, emission of ink particles and irradiation of the ink particles. After that, the inkjet printer 1 repeats the aforementioned steps, thereby permitting an image to be recorded on the recording medium 99.

In the aforementioned Embodiment, the ultraviolet ray source 5 is protected by the cover 9, and ink particles 98 emitted from the head 4 do not cure before hitting the recording medium 99. Further, the ultraviolet cure ink remaining at the outlet 4*b* of the head 4 do not cure.

To put it in greater details, the irradiation range α of the ultraviolet ray source 5 is restricted by the side surfaces 10*b*, 10*b* as shown in FIGS. 4(*b*) and 5(*a*), so ultraviolet rays are not applied directly to the trajectory of ink particles 98. Further, ultraviolet rays are not applied directly to the lower surface of the head 4. Therefore, ink particles do not cure before hitting the recording medium 99.

Figure 5:
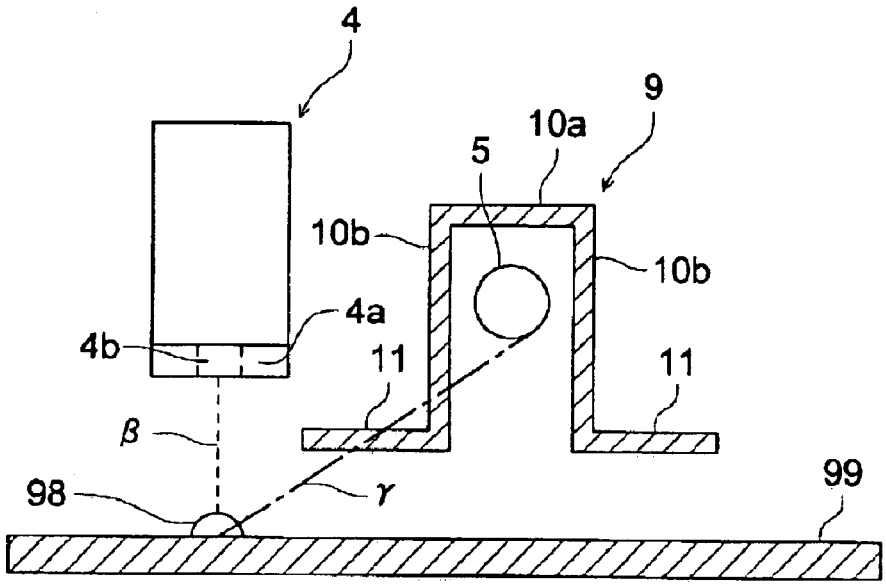
FIGS. 5(*a*) and (*b*) are front views representing heads arranged on the carriage and light sources arranged on both sides thereof, together with ultraviolet rays.
Figure 5:
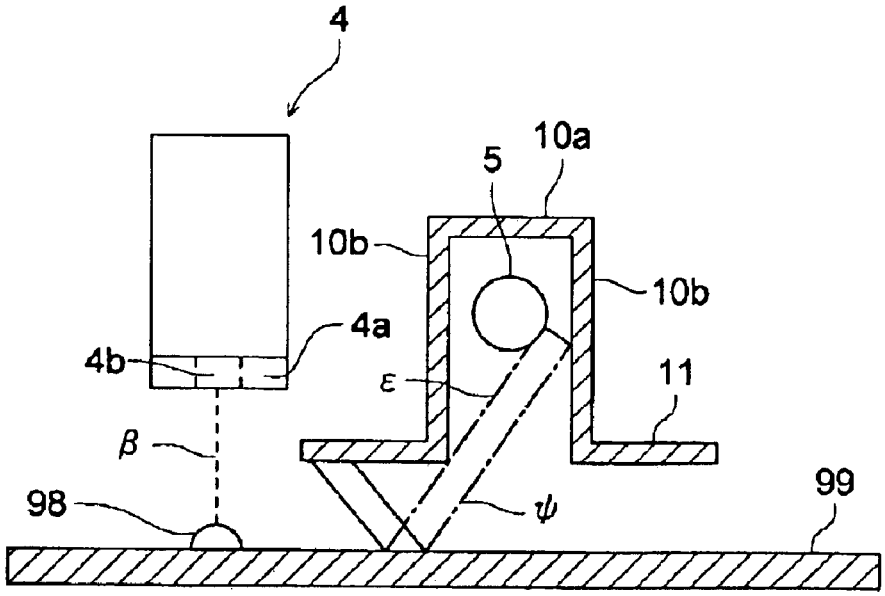

The lower end of the side surface 10*b* is provided with the flange 11, and the lower surface of the head 4 is flush with the flange 11 or is positioned above it. Because of this arrangement, the ultraviolet ray having launched onto the recording medium 99 from the ultraviolet ray source 5 enters the flange 11 even after having been reflected. (The path of the ultraviolet ray is indicated by arrow C in FIG. 4(*b*)). In particular, even if the light beam ϵ connecting between the lower end of the side surface 10 and the contact point of the ultraviolet ray source 5 is reflected by the recording medium 99, as viewed from the front, it enters the flange 11, as shown in FIG. 5(*b*). Therefore, ultraviolet rays emitted from the ultraviolet ray source 5 do not reach the trajectory β of ink particles 98 even if they are reflected by the recording medium 99 once. Indirect entry of the ultraviolet rays into the trajectory β is prevented by the flange 11. This also applies to the cases where ultraviolet rays are reflected once by a platen.

Even if light beam ψ reflected by the side surface 10*b* on the opposite side-is further reflected by the recording medium 99, it enters the flange 11. Accordingly, even if ultraviolet rays coming from ultraviolet ray source 5 are reflected once by the side surface 10*b* on the opposite side and once by the recording medium 99 (reflected twice in total), ultraviolet rays do not reach the trajectory β. Indirect entry of the ultraviolet rays into the trajectory β is prevented by the flange 1. This also applies to the cases where ultraviolet rays coming from the ultraviolet ray source 5 are reflected twice by the platen 15, without being reflected by the recording medium 99 for the second time.

The light beam ϵ reflected once and light beam ψ reflected twice are cut off by the flange 11. The flange 11 avoids indirect entry of ultraviolet rays into the trajectory β formed by ink particles 98 emitted from the adjacent head 4 and reaching the recording medium 99. Accordingly, ultraviolet rays reflected by the recording medium 99 are cut off by the flange 11, and do not enter the outlet 4*b* of the head 4 as a reference point of the trajectory β or the lower surface of the head 4. Because of this arrangement, ultraviolet cure ink remaining at the outlet 4*b* of the head 4 does not thicken or cure, with the result that no emission error occurs.

In particular, the flange 11 is made of the material having a high ultraviolet ray absorption rate, so the reflection efficiency of ultraviolet rays is extremely low. Moreover, the surface of the flange 11 is shaped in a rugged form, and this structure further reduces the reflection efficiency of ultraviolet rays. Thus, reflection of the ultraviolet rays is repeated by the recording medium 99 and flange 11, and ultraviolet rays do not reach the lower surface of the head 4 or the trajectory β.

The ultraviolet ray source 5 is protected by the cover 9 provided with the aforementioned flange 11, with the result that ultraviolet rays coming from the ultraviolet ray source 5 do not reach the lower surface of the head 4 or the trajectory β. Because of this arrangement, the space between the ultraviolet ray source 5 and head 4 can be made very small. Since the ultraviolet ray source 5 can be installed close to the head 4, ink particles 98 are exposed to ultraviolet rays immediately after having hit the recording medium, without increasing the traveling speed of the carriage 3. So ink does not stain on the recording medium 99. Since ink particles 98 do not cure before reaching the recording medium, dot formation failure does not occur. Thus, a high-quality image is provided by the inkjet printer 1.

[Second Embodiment]

Figure 6:
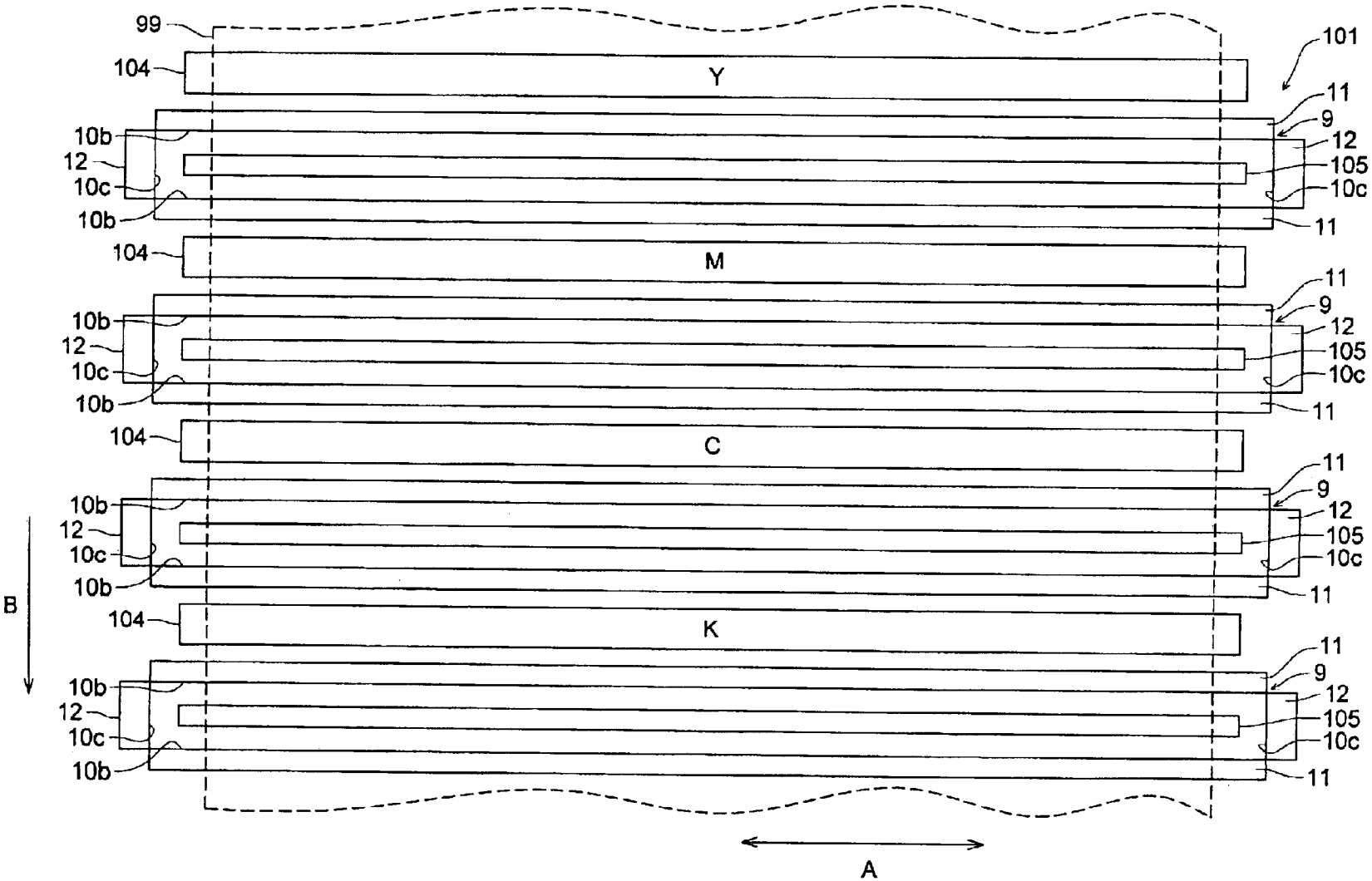
FIG. 6 is a bottom view of the major portions of the inkjet printer based on line head method according to the present invention.
Figure 7:
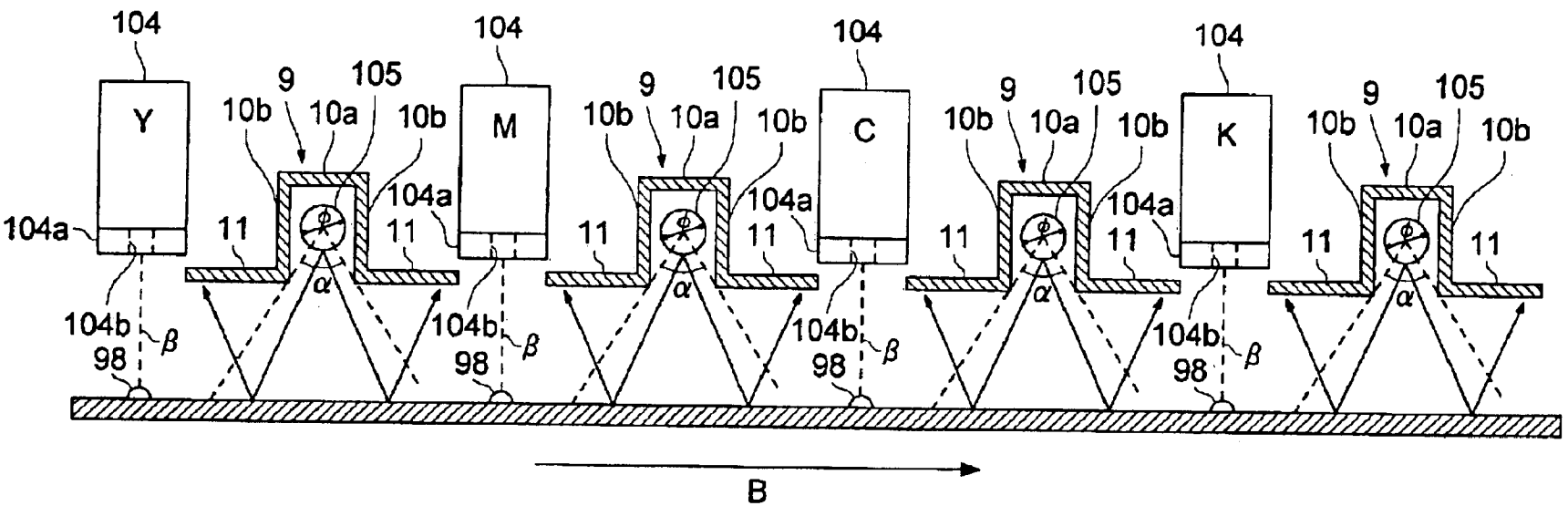
FIG. 7 is a side view representing the major portions of the inkjet printer illustrated in FIG. 6.

FIG. 6 is a bottom view of the major portions of the inkjet printer 101 as a second embodiment of the present invention. FIG. 7 is a side view representing the major portions of the inkjet printer 101. Similarly to the inkjet printer 1 as the first embodiment, the inkjet printer 101 as a second embodiment of the present invention comprises:

a platen 15 (not illustrated in FIGS. 6 and 7), ink tanks 6, 6, . . . (not illustrated in FIGS. 6 and 7), an ink feed path 7 (not illustrated in FIGS. 6 and 7), a variable pressure pumps 8, 8, . . . (not illustrated in FIGS. 6 and 7), and a feed mechanism. They are the same as those of the inkjet printer 1 according to the first Embodiment, and will not be described here to avoid redundancy.

The difference between the inkjet printer 1 of the first Embodiment and the inkjet printer 101 of the second Embodiment is found in that, while the inkjet printer 1 shown in FIGS. 1 and 2 use a serial method to record an image on the recording medium 99, the inkjet printer 101 shown in FIGS. 6 and 7 use a line head method to record an image on the recording medium 99.

The following describes the details: In the inkjet printer 1, a base (not illustrated) instead of the guide member 2 and carriage 3 is arranged above the platen 15 and recording medium 99, and a plurality of line heads 104, 104, . . . are mounted on this base.

The line head 104 is mounted on the base in such a way that it extends in the direction orthogonal to the sub-scanning direction B, i.e. across the width of the recording medium 99. Line heads 104, 104, . . . are arranged in the sub-scanning direction B so that they will be parallel to one another in the longitudinal direction.

A nozzle plate 104*a* is arranged on the lower surface of each line head 104. This nozzle plate 104*a* is placed opposite to the lower platen 15 and recording medium 99. A plurality of outlets 104*b*, 104*b*, . . . for emitting ink are formed in a row on the nozzle plate 104*a* in the direction orthogonal to the sub-scanning direction B (i.e. in the main scanning direction A). Each line head 104 has for each outlet 104*b* a piezoelectric element for applying pressure to internal ink by deformation, a heating element for applying pressure to internal ink through film boiling of internal ink, and other elements for applying pressure to internal ink. Ink is emitted separately from each outlet 104*b* by the operation of these elements. Ink having any one of the colors Y, M, C, K, LY, LM, LC and LK is emitted from one line head 104. Ink of a different color for each line head 104 is emitted. The alphabet shown on each line head 104 in FIGS. 6 and 7 signifies the color of ink to be emitted.

An ultraviolet ray source 105 corresponding to each line head 104 is provided. To put it in greater details, the ultraviolet ray source 105 is arranged downstream of the corresponding line head 104 in the sub-scanning direction, and above the nozzle plate 104*a* on the lower surface of the corresponding line head 104. Therefore, the distance from the recording medium 99 and platen 15 to the ultraviolet ray source 105 is greater the distance from the recording medium 99 and platen 15 to the line head 104.

The ultraviolet ray source 105 is a linear light source in the direction orthogonal to the sub-scanning direction B, i.e. in the main scanning direction A, and is mounted on the case so that it can extends over the entire width of the recording medium 99. A LED (light emitting diode), fluorescent lamp, high pressure mercury lamp, metal halide lamp, high pressure spot lamp and xenon lamp can be utilized as this ultraviolet ray source 105.

Similarly to the ultraviolet ray sources 5 according to the first embodiment, the ultraviolet ray sources 105, 105, . . . are protected by covers 9, 9, . . . . Similarly to the case in the first embodiment, each cover 9 comprises:

a top surface 10*a* opposite to the regular inspection 99 and platen 15 above the ultraviolet ray source 105 side surfaces 10*c*, 10*c* extending downwardly from both ends of the top surface 10*a* in the main scanning direction A, side surfaces 10*b*, 10*b* extending downwardly from both ends of the top surface 10*a* in the sub-scanning direction B, flanges 12, 12 extending in the main scanning direction A from the lower end of the side surface 10*c*, and flanges 11, 11 for emission from the lower end of the side surface 10*b* toward the trajectory β of ink particles 98 emitted from the adjacent line head 104, Each side 10*b* is arranged between the ultraviolet ray source 105 and its adjacent line head 104. It extends toward the recording medium 99 further than the lower surface of the line head 104, and the lower end of the side surface 10*b* is located below the lower surface of the line head 104. The irradiation range α of the ultraviolet ray source 105 is restricted by two side surfaces 10*b*, 10*b*. To put it in greater details, ultraviolet rays emitted from the ultraviolet ray source 105 is cut off by the side surface 10*b* to ensure the ultraviolet rays emitted from the ultraviolet ray source 105 do not directly enter the trajectory formed by ink particles 98 emitted from the adjacent line head 104 and reaching the recording medium 98.

The flange 11 is located below the lower surface of the line head 104. The lower surface of the flange 11 is positioned opposite to the recording medium 99.

It is also possible that the flange 11, the lower surface of the flange 11 in particular, is flush with the lower surface of the line head 104, and the space from the lower surface of the flange 11 to the recording medium 99 is the same as the space from the lower surface of the line head 104 to the recording medium 99.

The lower surface of the flange 11 or the entire flange 11 is provided with a material of high ultraviolet ray absorption rate through various types of metal oxide treatment such as alumite treatment, plating, vapor deposition and sputtering, and coating of various types of ultraviolet ray absorbents. So the lower surface of the flange 11 absorbs ultraviolet rays. The flange 11, especially the lower surface thereof, is formed in a rugged shape.

The following describes the operation of the inkjet printer 101 as a second embodiment:

While a feed mechanism feeds the recording medium 99 in the sub-scanning direction B, the line head 104 emits ink to each line, and then an image is recorded on the recording medium 99. While the ink particles 98 having reached the recording medium 99 is traveling below the ultraviolet ray source 105 on the downstream side in the sub-scanning direction B as the recording medium 99 is fed, ultraviolet rays coming from the ultraviolet ray source 105 enter the ink on the recording medium 99. This causes ink particles 98 to be cured. If the recoding method as represented by the second Embodiment is based on the line system, the direction of relative movement of the recording medium 99 with respect to the line head 104 corresponds to the sub-scanning direction B when the line heads 104, 104 emit ink and an image is recorded on the recording medium 99. The ultraviolet ray source 105 having been located downstream of the line head 104 in the sub-scanning direction B is now located backward from the line head 104 in the relative traveling direction of the line head 104 with respect to the recording medium 99. In the second embodiment, it is also possible to provide a feed-mechanism for continuous feed of the recording medium 99 instead of intermittent feed.

In the inkjet printer 101 according to the second embodiment, similarly to the inkjet printer 1 according to the first embodiment, the side surfaces 10*b*, 10*b* of the cover 9 extend downward from the adjacent lower surface of the line heads 104, 104, respectively. So the irradiation range $\alpha$ of the ultraviolet ray source 105 is restricted by the side surfaces 10*b*, 10*b*, with the result that ultraviolet rays emitted from the ultraviolet ray source 105 do not indirectly enter the trajectory $\beta$ of ink particles 98.

The lower surface of the line head 104 is positioned above the flange 11. Therefore, even if the ultraviolet rays having entered the recording medium 99 from the ultraviolet ray source 105 are reflected, they enter the flange 11, without reaching the trajectory $\beta$ of the ink particles 98. The flange 11 avoids indirect entry of ultraviolet rays into the trajectory subsequent to one reflection.

The ultraviolet rays reflected by the side surface 10*b* are reflected by the recording medium 99 to enter the flange 11. Accordingly, even if ultraviolet rays emitted from the ultraviolet ray source 105 are reflected once from the side surface 10*b* and once from the recording medium 99 (twice in total), ultraviolet rays do not enter the trajectory $\beta$ of ink particles 98. Double reflection of ultraviolet rays and indirect entry into the trajectory $\beta$ are also prevented by the flange 11.

Similarly to the description of the first Embodiment with reference to FIG. 5, light beam $\epsilon$ reflected once and light beam $\psi$ reflected twice are cut off by the flange 11. This arrangement allows the flange 11 to ensure that ultraviolet rays emitted from the ultraviolet ray source 105 do not enter the trajectory formed by ink particles 98 emitted from the adjacent line head 104 and reaching the recording medium 98. Thus, ultraviolet rays reflected by the recording medium 99 are cut off by the flange 11, and do not enter the lower surface of the line head 104.

Especially the flange 11 is made of the material having a high ultraviolet ray absorption rate, and has a very low efficiency in reflecting ultraviolet rays entering the flange 11. Further, the flange 11 is provided with a rugged surface, and this further reduces the efficiency of reflecting the ultraviolet rays entering the flange 11. Accordingly, repeated reflection of ultraviolet rays by the recording medium 99 and flange 11 is also prevented by the flange 11.

Because of this arrangement, ultraviolet cure ink remaining at the outlet 104*b* of the head 104 does not cure, with the result that no emission error occurs.

The prevent invention is not restricted to the aforementioned embodiments. It permits various improvements and design modifications without departing from the spirit of the invention.

For example, in the aforementioned first embodiment, a plurality of heads 4, 4, . . . are arranged in one row. Multiple rows, each row comprising a plurality of heads arranged in the main scanning direction A, can be mounted on the carriage (for example, a plurality of heads can be arranged in a matrix form on the carriage). In this case as well, ultraviolet ray sources and heads are arranged alternately in each row.

In the aforementioned first embodiment, ink is emitted when the carriage 3 moves to the left in FIG. 1 within the recording range as well as to the right. However, ink particles may be emitted only during the traveling in one direction. In this case, the ultraviolet ray source 5 on the leftmost position need not be provided if ink particles are emitted only when the carriage 3 moves to the left. Similarly, the ultraviolet ray source 5 on the rightmost position need not be provided if ink is emitted only when the carriage 3 moves to the right.

In the aforementioned first embodiment, outlets 4*b* are arranged on the lower surface of the head 4 linearly in one row in the sub-scanning direction B. The lower surface of the head 4 may be provided with multiple rows, each row consisting of a plurality of outlets 4*b* arranged linearly in the sub-scanning direction B. In the case of the second embodiment as well, the lower surface of the line head 104 may be provided with multiple rows, each row consisting of multiple outlets 104*b* arranged linearly in the main scanning direction A. The plural outlets 104*b* of each line head are not necessarily provided strictly parallel to the main scanning direction A, and are not necessarily arranged on a strait line.

In the aforementioned first embodiment, the colors of the ultraviolet cure ink emitted from the outlets 4 of each head 4 are the same, but the ultraviolet cure ink of different color may be emitted from the outlets 4 of each head 4. Similarly, in the second embodiment, ink of different colors may be emitted from the outlets 104*b* of each line head 104.

Figure 8:
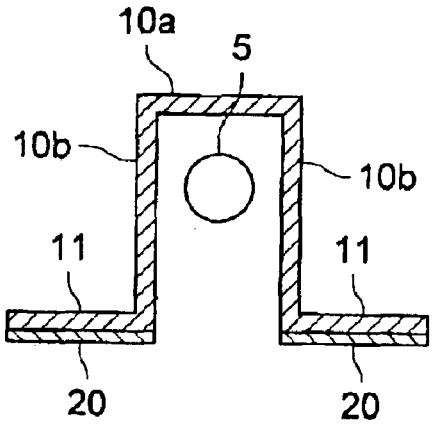
FIGS. 8(*a*) and (*b*) are cross sectional views illustrating the front view of an application example of a light source cover.
Figure 8:
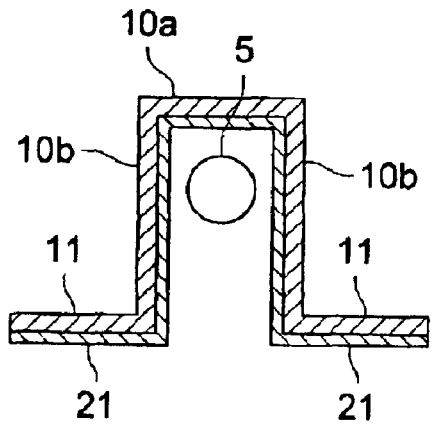

In the aforementioned embodiments, the flange 11 need not have a high ultraviolet ray absorption rate. For example, an ultraviolet ray absorbing material 20 characterized by high ultraviolet ray absorption rate can be is affixed, bonded or fixed on the lower surface of the flange 11, as shown in FIG. 8(*a*). Further, the ultraviolet ray absorbing material 21 can be affixed, bonded or fixed on not only the flange 11 but also the entire internal surface of the box 10, namely the side surfaces 10*b*, 10*b*, side surfaces 10*c*, 10*c* and top surface 10*a*, as shown in FIG. 8(*b*). The ultraviolet ray absorbing material 20 and 21 includes;

a sheet material composed of non-woven fabric and carbon black, a sheet material with powdery inorganic substance including titanium oxide formed into extra-fine particles, zinc oxide, and iron oxide bonded on the surface, a sheet material composed of organic substances such as benzotriazole compound and aromatic compound, and a sheet with the aforementioned organic substance bonded on the surface.

In the aforementioned embodiments, ultraviolet cure ink is used as active ray cure ink. However, the active ray cure ink needs not be restricted to ultraviolet cure ink. For example, electron beam cure ink can be utilized as active ray cure ink. In case of irradiation by electron beam, polymerization of monomer (oligomer) is known to be performed by radical reaction without the need of using such a photocatalyst as photoreactive initiator. Accordingly, unlike the ultraviolet cure ink, the ink that includes a pigment and monomer (oligomer) but not high-priced photoreactive initiator can be used as electron beam cure ink. This allows a high-strength image to be recorded on the recording medium 99 at a reduced cost. When the electron beam cure ink is used, it goes without saying that an electron beam source for applying electron beam to the recording medium 99 is mounted on the carriage 3 and base, instead of an ultraviolet ray source 5 and 105. In this case, the flange 11 is preferred to be made of the material capable of absorbing electron beam.

Figure 9:
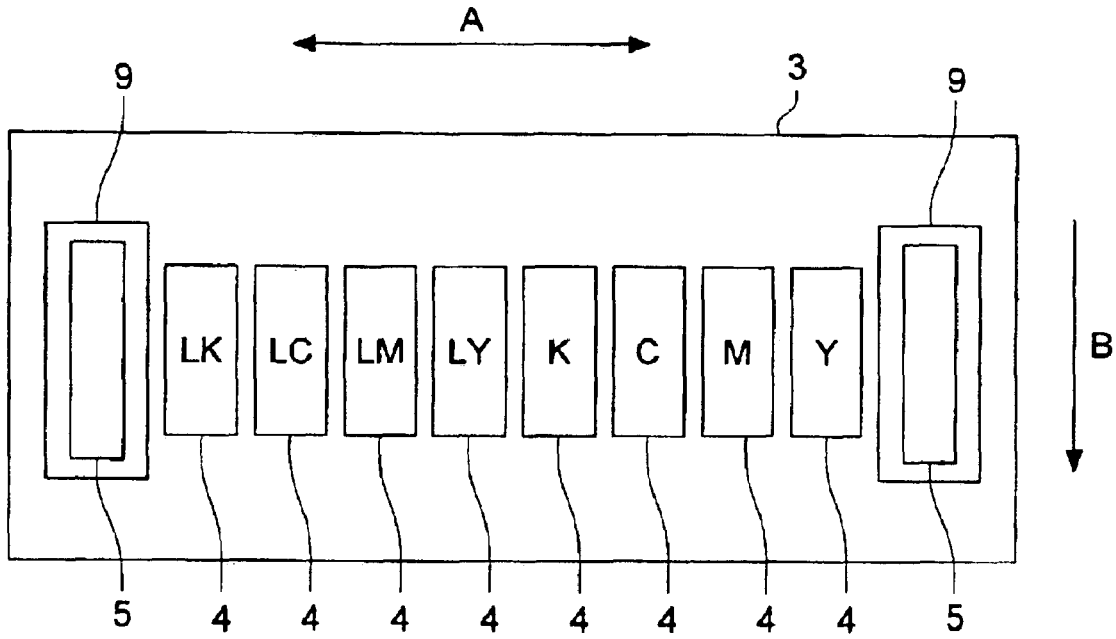
FIG. 9 is a bottom view showing an application example of the arrangement of a head and UV source.

In the aforementioned first embodiment, ultraviolet ray sources 5 and heads 4 are arranged alternately. As shown in FIG. 9, ultraviolet ray sources 5, 5 can be mounted on the carriage 3 on both sides of a row of a plurality of heads 4, 4, . . . in the main scanning direction A. In the case of FIG. 9, each of the ultraviolet ray sources 5, 5 is protected by the aforementioned cover 9. In this case, if the carriage 3 moves to the left in the main scanning direction A, ink is emitted by the heads 4, 4, . . . , and the image is recorded on the recording medium 99, then the ultraviolet ray source 5 positioned on the right end in the main scanning direction A is the light source located backward from the head 4 in the relative traveling direction of the head with respect to the recording medium 99. If the carriage 3 moves to the right in the main scanning direction A and an image is recorded on the recording medium 99, then ultraviolet ray source 5 located on the left end in the main scanning direction A is the light source positioned backward from the head 4 in the relative traveling direction of the head with respect to the recording medium 99.

Figure 10:
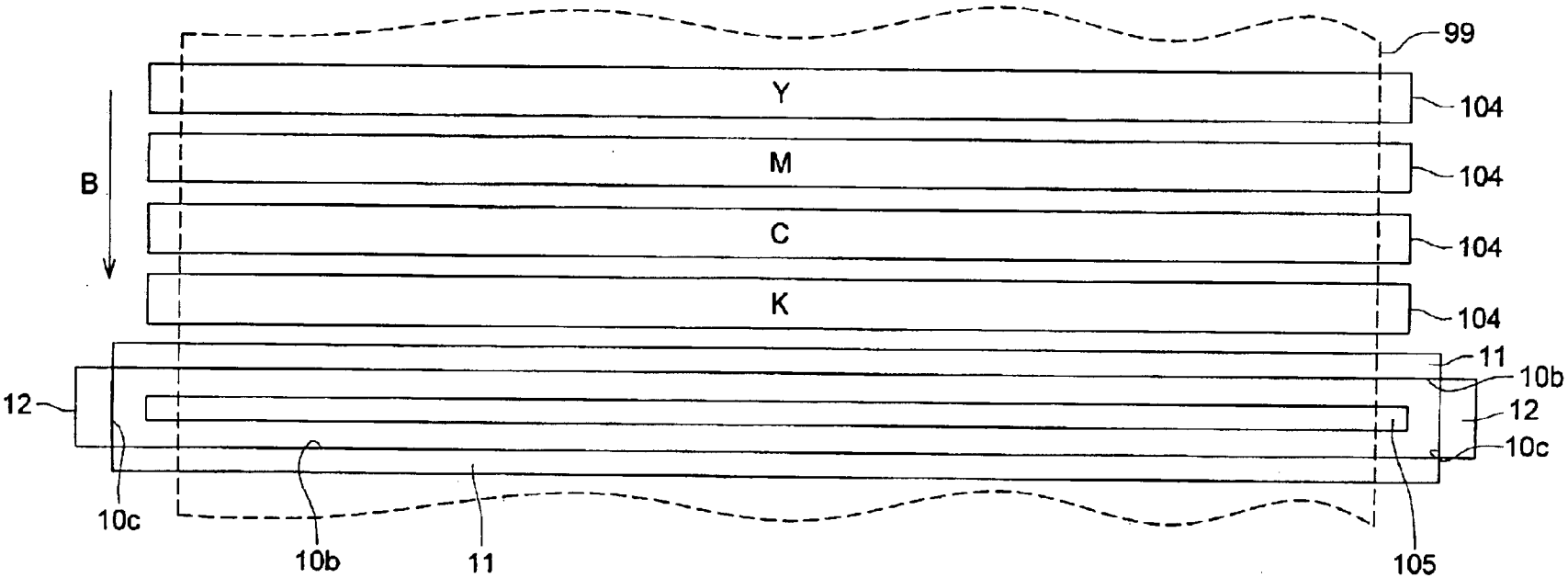
FIG. 10 is a bottom view showing an application example of the arrangement of a line head and UV source.

In the aforementioned second embodiment, the ultraviolet ray source 105 is arranged downstream of each of the line heads 104, 104, . . . in the sub-scanning direction B. It is also possible to place the ultraviolet ray source 105 on only the downstream (in the sub-scanning direction B) of the line head 104 located at the most downstream position in the sub-scanning direction B, as shown in FIG. 10. In the case of FIG. 10 as well, the aforementioned cover 9 is placed on the ultraviolet ray source 105.

Figure 11:
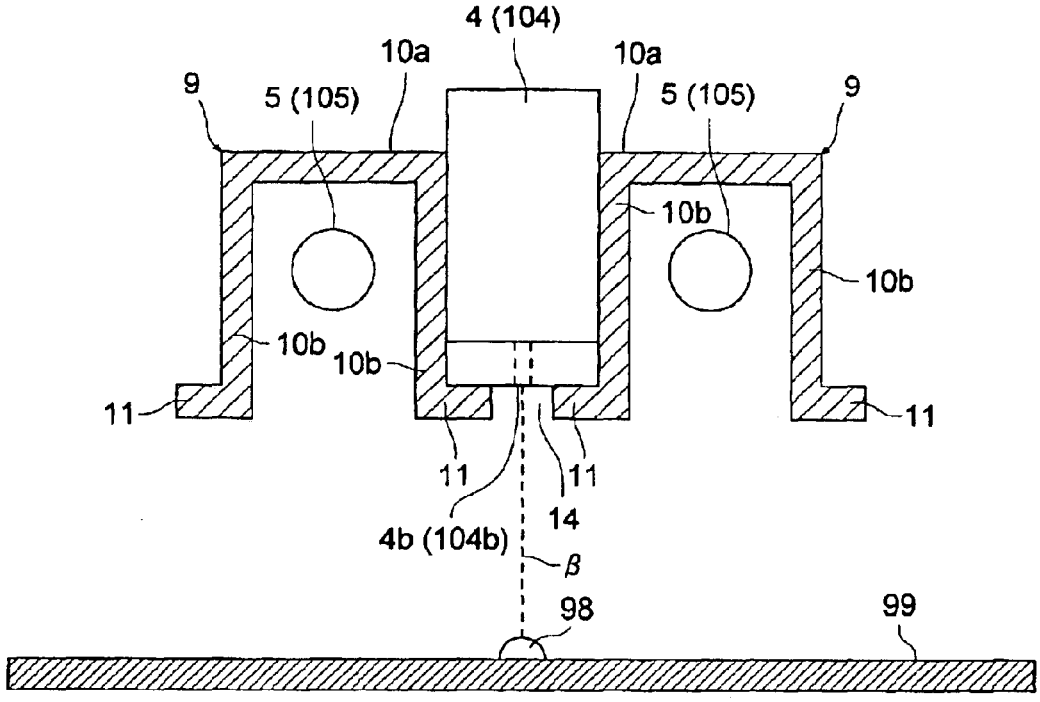
FIGS. 11(*a*) and (*b*) are drawings showing application examples of the arrangement of the cover arranged on both sides of the head or line head.
Figure 11:
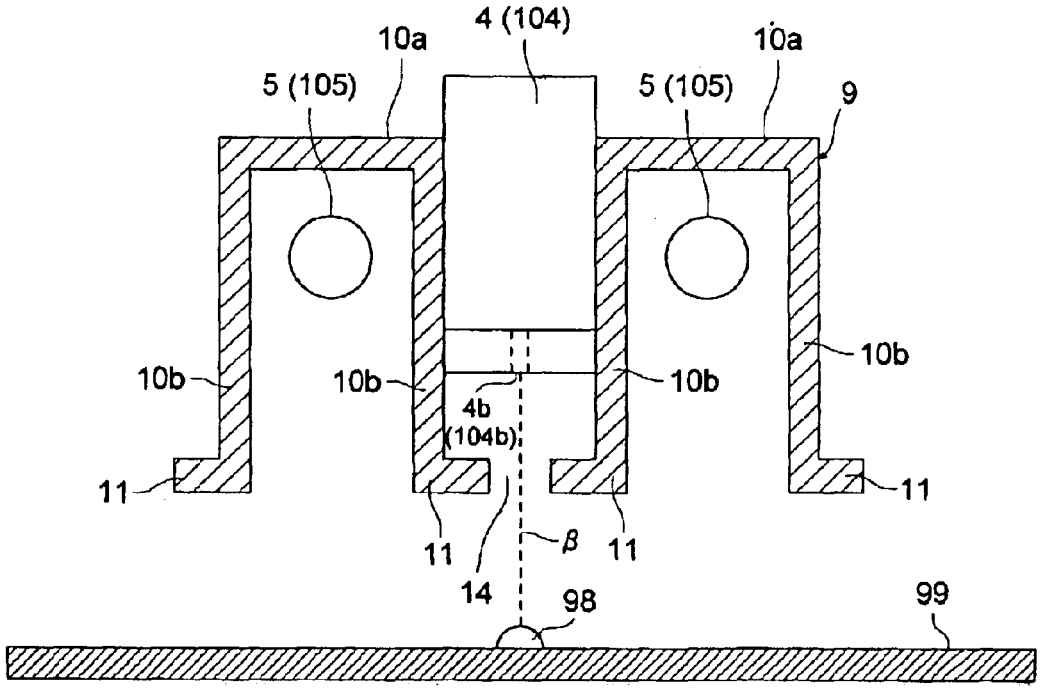

In the aforementioned embodiment, the side surface 10*b* of the cover 9 is separate from the head 4 or line head 104. As shown in FIG. 11, the cover 9 can be mounted with the side surface 10*b* abutting the both sides of the head 4 in the main scanning direction A. It is also possible that the cover 9 is mounted on the line head 104 with the side surface 10*b* abutting both sides of the line head 104 in the sub-scanning direction B. In this case as well, the outlet 4*b* of the head 4 or the outlet 104*b* of the line head 104 are arranged above the space 14 between the flanges 11, 11 of the two adjacent covers 9, 9. Further, in this case, since the flanges 11, 11 of the two adjacent covers 9, 9 extend toward the trajectory, part of the flanges 11, 11 overlaps part of the head 4 or part of the line head 104, as viewed from the front. Part of the top surfaces of the flanges 11, 11 can abut part of the lower surface of the head 4 or part of the lower surface of the line head 104 ((a) in FIG. 11), or can be apart from part of the lower surface of the head 4 or part of the lower surface of the line head 104 ((b) in FIG. 11). In either case, the outlet 4*b* of the head 4 and the outlet 104*b* of the line head 104 are arranged above the space 14 between the flanges 11, 11 of two covers 9, 9. The outlet 4*b* of the head 4 and the outlet 104*b* of the line head 104 do not over the flanges 11, 11, as viewed from the front.

Figure 12:
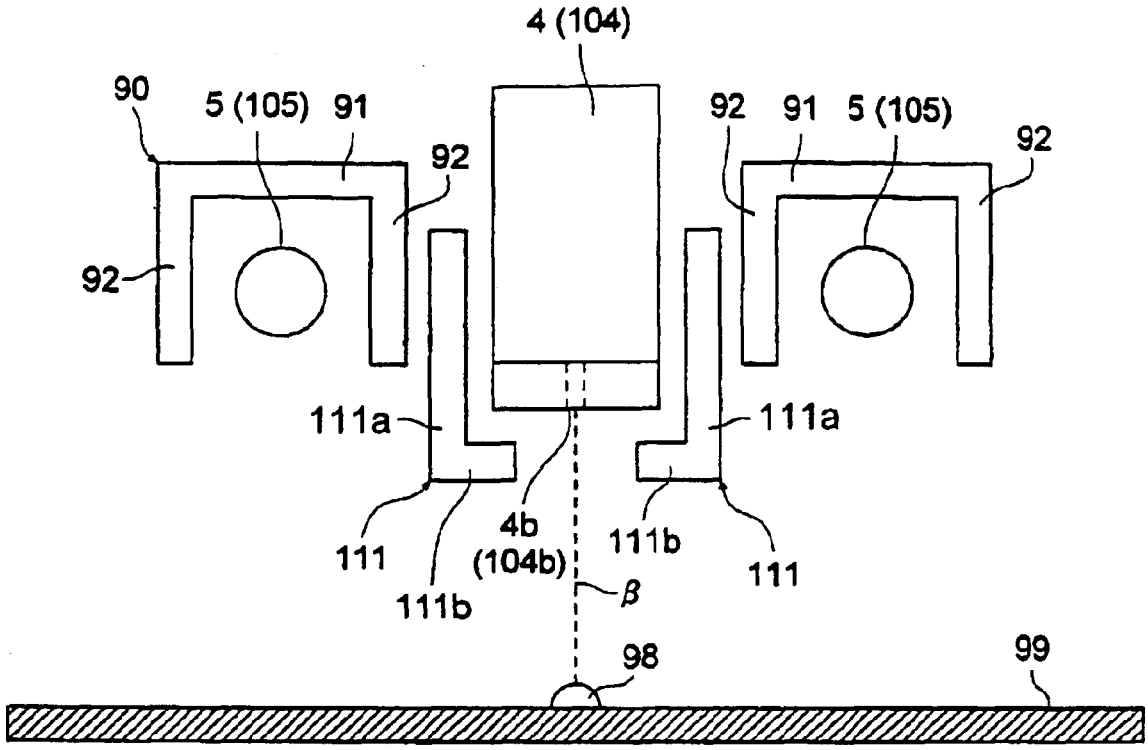
FIG. 12 is a drawing showing an application example of the shielding member arranged on both sides of the head or line head.

In the aforementioned embodiments, the side surface 10*b* of the cover 9 is used as a shielding member. A shielding member can be provided apart from the cover 9. As shown in FIG. 12, for example, a cover 90 apart from the cover 9 is placed on the ultraviolet ray sources 5, 5 or ultraviolet ray sources 105, 105 arranged on both adjacent sides of the head 4 or line head 104. Apart from this cover 90, shielding members 111, 111 are arranged between head 4 and ultraviolet ray sources 5, 5 or between line head 104 and ultraviolet ray sources 105, 105. The cover 90 comprises the top surface 91 opposite to the recording medium 99 and platen 15, and side surfaces 92, 92 extending downward from both ends of the top surface 91, and its bottom is open. The lower ends of the side surfaces 92, 92 of the cover 90 can be placed below the lower surface of the head 4 or line head 104, or can be placed above the lower surface of the head 4 or line head 104.

The shielding member 111 is placed between the side 92 of the cover 90 and head 4, or between the side surface 92 of the cover 90 and line head 104. The shielding member 111 comprises a first extension member 111*a* that extends toward the recording medium 99 further than the lower surface of the head 4 or line head 104, and a second extension member 111*a* that extends horizontally from the lower end of the first extension member 111*a* toward the trajectory β of ink particles 98 emitted from the head 4 or line head 104. The shielding member 111 is shaped approximately in the form of a letter L. This shielding member 111 can be mounted on the head 4 or line head 104 so as to abut the side surface of the head 4 or line head 104, or can be installed on the cover 90 so as to abut the side surface 92 of the cover 90. Alternatively, the shielding member 111 can be mounted on the carriage 4 where the head 4 is mounted, or on the base where the line head 104 is installed. Similarly to the flange 11, the lower surface of the second extension member 111*b* is formed in a rugged shape, and has a high ultraviolet ray absorption rate.

Further, when the shielding member 111 is provided, the ultraviolet ray source 5 or ultraviolet ray source 105 need not be protected with a cover 90.

The second extension member 111*b*, especially the lower surface of the second extension member 111*b*, can be flush with the lower surface of the head 4 or line head 104, or the lower surface of the second extension member 111*b*, can be located below the lower surface of the head 4 or line head 104.

Similarly to the side surface 10*b* of the cover 9 illustrated in FIGS. 4 and 7, the first expansion member 111*a* of the shielding material 111 extends toward the recording medium 99 further than the lower surface of the head 4 or line head 104. Because of this structure, the first extension member 111*a* prevents direct entry of ultraviolet cure ink emitted from the ultraviolet ray source 5 or ultraviolet ray source 105 into the trajectory formed by ink particles 98 emitted from the adjacent head 4 or line head 104 and reaching the recording medium 99.

Similarly to the flange 11 of the cover 9 shown in FIGS. 4 and 7, the second extension member 111*b* extends from the lower end of the first extension member 111*a* toward the trajectory β. The second extension member 111*b* is flush with the head 4 or line head 104 or is positioned below the head 4 or line head 104. Because of this arrangement, despite reflection of the ultraviolet rays having entered the recording medium 99 from the ultraviolet ray source 5 or ultraviolet ray source 105, ultraviolet rays enter the second extension member 111*b*. This prevents ultraviolet rays from reaching the trajectory β of the ink particles 98. Reflection of ultraviolet rays and indirect entry into the trajectory β are also prevented by the second extension member 111*b*. Further, even if the ultraviolet rays are reflected by the inner surface of the cover 90, they enter the second extension member 111*b*. Accordingly, even if ultraviolet rays emitted from ultraviolet ray source 5 or ultraviolet ray source 105 are reflected by the cover 90 or the recording medium 99, the do not reach the trajectory β of the ink particles 98. Thus, more than two reflections of ultraviolet rays and indirect entry into the trajectory β are prevented by the second extension member 111*b*.

EFFECTS OF THE INVENTION

The present invention uses a shielding member that prevents the active ray emitted from the active ray source from entering directly or indirectly the trajectory formed by ink particles emitted from the head and reaching the recording medium. This function decreases the possibility that ink particles emitted from the head are exposed to active ray before hitting the recording medium and are cured, and ensures the recording with high image quality. Use of such a shielding member permits the active ray source to be installed closer to the head. Thus this makes it possible that, immediately after hitting the recording medium, ink particles are exposed to the active ray coming from the active ray source, and are hence cured immediately after hitting the recording medium without ink particles unnecessarily spreading on the recording medium or blotting.

Since the shielding member prevents the active ray emitted from the active ray source from entering into the starting point of an ink particle trajectory, the ink at the ink outlet of the head is restrained from being thickened or cured. This function prevents the ink particle emission error for a long period.

What is claimed is:

1. An inkjet printer comprising:

a head for emitting an active ray cure ink onto a recording medium;

an active ray source for emitting an active ray to cure the active ray cure ink, wherein the active ray source is arranged at a rear of the head in a direction of a relative movement of the head with respect to the recording medium during emission of the active ray cure ink, and wherein the active ray source is arranged in a same side where the head is provided with respect to the recording medium; and a shield member for preventing the active ray emitted by the active ray source from directly or indirectly entering into a trajectory formed by an ink particle emitted from the head and reaching the recording medium, said shield member being arranged between the active ray source and the head, and said shield member being provided with:

a first extension member extending in a first extending direction toward the recording medium and closer to a surface of the recording medium than a surface of the head from which the ink particles are emitted; and a second extension member extending from the first extension member toward the trajectory and closer to the trajectory than the first extension member, in a second extending direction crossing the first extending direction.

2. An inkjet printer comprising:

a head for emitting an active ray cure ink onto a recording medium;

an active ray source for emitting an active ray to cure the active ray cure ink, wherein the active ray source is arranged at a rear of the head in a direction of a relative movement of the head with respect to the recording medium during emission of the active ray cure ink, and wherein the active ray source is arranged in a same side where the head is provided with respect to the recording medium; and a shield member for preventing the active ray emitted by the active ray source from directly or indirectly entering into a trajectory formed by an ink particle emitted from the head and reaching the recording medium, said shield member being arranged between the active ray source and the head, and said shield member being provided with:

a first extension member extending in a first extending direction toward the recording medium and closer to a surface of the recording medium than a surface of the head from which the ink particles are emitted; and a second extension member extending from the first extension member toward the trajectory, in a second extending direction crossing the first extending direction;

wherein a surface of the second extension member opposite to the recording medium is formed in a convexo-concavo form.

3. An inkjet printer comprising:

a head for emitting an active ray cure ink onto a recording medium;

an active ray source for emitting an active ray to cure the active ray cure ink, wherein the active ray source is arranged at a rear of the head in a direction of a relative movement of the head with respect to the recording medium during emission of the active ray cure ink, and wherein the active ray source is arranged in a same side where the head is provided with respect to the recording medium; and a shield member for preventing the active ray emitted by the active ray source from directly or indirectly entering into a trajectory formed by an ink particle emitted from the head and reaching the recording medium, said shield member being arranged between the active ray source and the head, and said shield member being provided with:

a first extension member extending in a first extending direction toward the recording medium and closer to a surface of the recording medium than a surface of the head from which the ink particles are emitted; and a second extension member extending from the first extension member toward the trajectory, in a second extending direction crossing the first extending direction;

wherein a surface of the second extension member opposite to the recording medium is absorbable of the active ray.

4. The inkjet printer of claim 1, wherein the head, the active ray source and the shield member are mounted so as to be integrally movable in the direction of the relative movement of the head.

5. The inkjet printer of claim 1, wherein the recording medium is transported in a reverse direction to the direction of the relative movement of the head, and the head is arranged along a direction orthogonal to the direction of the relative movement of the head.

6. The inkjet printer of claim 1, wherein the active cure ink comprises a cation cure ink.

* * * * *